United States Patent [19]

Peterson

[11] Patent Number: 4,655,082

[45] Date of Patent: Apr. 7, 1987

[54] MINING MACHINE HAVING VIBRATION SENSOR

[75] Inventor: Carl R. Peterson, Boxford, Mass.

[73] Assignee: Massachusetts Institute of Technology, Cambridge, Mass.

[21] Appl. No.: 761,043

[22] Filed: Jul. 31, 1985

[51] Int. Cl.[4] ..... G01V 29/00; E21C 39/00

[52] U.S. Cl. ..... 73/594; 299/1

[58] Field of Search ..... 73/579, 588, 594; 299/1

[56] References Cited

U.S. PATENT DOCUMENTS

| | | | |
|---|---|---|---|
| 2,620,386 | 12/1952 | Alspaugh | 177/311 |
| 2,712,753 | 7/1955 | Campbell | 73/67 |
| 2,790,968 | 4/1957 | Cook | 340/261 |
| 2,944,804 | 7/1960 | Persson et al. | 262/7 |
| 3,015,477 | 1/1962 | Persson et al. | 262/27 |
| 3,315,663 | 4/1967 | Goldfarb | 128/4 |
| 3,550,959 | 12/1970 | Alford | 299/1 |
| 3,693,417 | 9/1972 | Fritz et al. | 73/81 |
| 3,771,830 | 11/1973 | Hartley et al. | 299/1 |
| 4,143,552 | 3/1979 | Godfrey | 73/579 |
| 4,158,368 | 6/1979 | Clark | 137/487.5 |
| 4,181,360 | 1/1980 | Wilson | 299/1 |
| 4,367,899 | 1/1983 | Whittaker et al. | 299/1 |
| 4,368,919 | 1/1983 | Whittaker et al. | 299/1 |
| 4,423,635 | 1/1984 | Senicourt | 73/593 |
| 4,591,209 | 5/1986 | Droscher et al. | 299/1 |

FOREIGN PATENT DOCUMENTS 976074 7/1981 U.S.S.R. .

*Primary Examiner*—Howard A. Birmiel

*Attorney, Agent, or Firm*—Hamilton, Brook, Smith & Reynolds

[57] ABSTRACT

A mining machine having means for sensing property variations of the materials associated with a seam of a mine. The machine comprises a member (4) which rotates about an axis A. The rotatable member mounts at least one cutter 6 spaced from the axis for cutting material from the seam. A rod (10) carried by the rotatable member is held in releasable engagement with the cutter. The rod extends to the axis of the rotatable member to conduct to the axis, strain waves which are induced by variations in cutter vibration as the cutter encounters property variations of the materials associated with the seam. A transducer (24,54) is located at the axis of the rotatable member in communication with the rod to convert the strain waves in the rod to electric signals which may be recorded or visually displayed.

15 Claims, 9 Drawing Figures

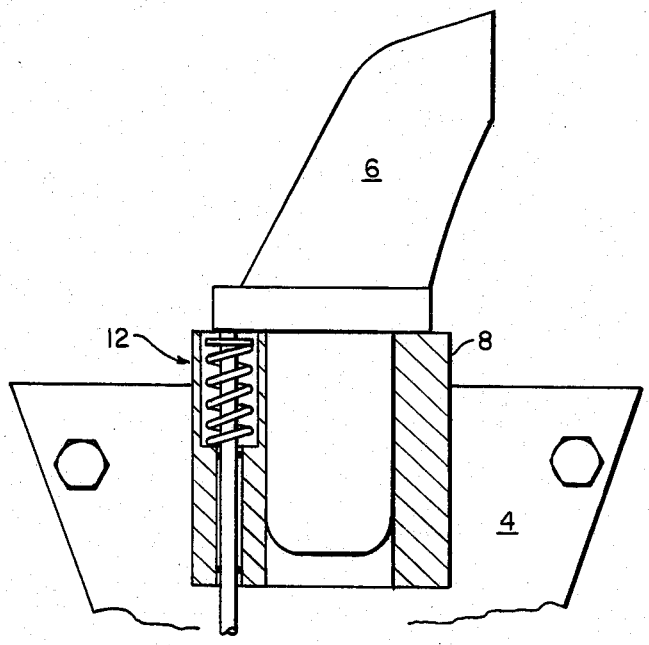
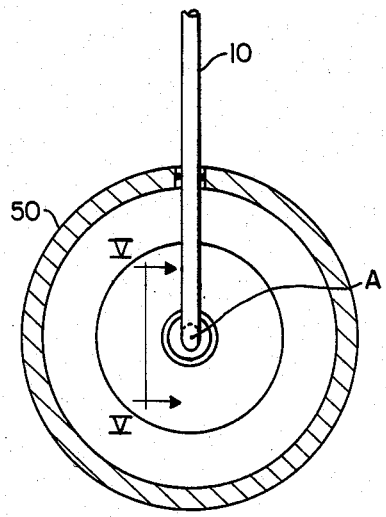
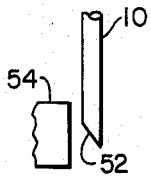
Fig. 5A
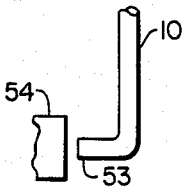
Fig. 5B
Fig. 5

MINING MACHINE HAVING VIBRATION SENSOR

FIELD OF THE INVENTION

This invention relates to mining in general and, more particularly, to automatic mining machinery which has means for sensing property variations of the materials associated with a seam of a mine and for converting the variations into electric signals which may be used for guiding the automatic machinery.

BACKGROUND OF THE INVENTION

Coal and other sedimentary deposits exist in nature in generally parallel layers or seams of considerable length and breadth. Often the seams are bounded above and below by layers of other materials such as rock, shale, sandstone, and other materials. In mining, it is obviously desirable to remove just the useful deposits, such as coal, without simultaneously removing rock or any other contaminant.

One technique for removing coal from seams is called the longwall method where an excavating machine traverses back and forth along the wall as it removes material from the wall. The coal is actually removed from the seam by rotary members employing cutters which scrape, break, and otherwise loosen the coal from the seam from which it is automatically conveyed to the surface of the mine. A coal seam is not necessarily flat nor of uniform vertical dimension. Seams are frequently found to undulate and vary in height.

It has long been recognized that there is a need for some sort of sensor to "read" the characteristics of the seam in order to control the vertical movement of the cutters as the machines traverse the seam. Many attempts have been made to develop automatic sensing devices whereby machines may be controlled by operators remote from the machine in response to signals or "readings" taken by the machine itself.

One example of a long wall mining machine is shown in U.S. Pat. No. 4,143,552 to Godfrey. The machine is moved lengthwise of the seam on tracks and has a ranging arm mounting a rotatable cutting member or cutter head for heightwise adjustment as well as rotation. The cutting member mounts cutters at its periphery which remove the coal from the seam.

The patent discloses a vibration transducer in the form of one or more accelerometers mounted on the cutter support or ranging arm to sense sonic vibrations and convert them into electric signals. While this type of device does sense vibration, being mounted on the support arm, it also picks up the vibration from all of the cutters causing impure signals to be produced and cannot locate the source of the vibration.

To eliminate this problem, various attempts were made to sensitize only a single cutter in a rotary member employing a plurality of cutters. Such cutters were initially employed to detect the barrier between coal and rock. However, such barriers are not always distinct and misleading signals were obtained. Furthermore, it is often necessary to leave a layer of coal adjacent the roof or top of the seam as well as on the bottom or floor. But cutters which can only detect a coal rock interface are inadequate for this purpose.

Another problem with sensitized cutters employed heretofor, was that they were equipped with strain gages or accelerometers, which, for the most part, were not durable enough to be employed in commercial applications.

Attempts were made to transmit cutter signals from the rotating member to the non-rotating machine frame or ranging arm by way of electrical slip rings and/or battery powered radio transmitters. Due to mine safety requirements, such electrical equipment, could not, for one reason or another, comply with safety regulations and slip rings could not withstand the rigors of mining operations or the continuous presence of dirt and dust. Accordingly the apparatus did not meet with commercial success.

Accordingly, the present invention has as one of its objectives to provide apparatus for producing signals from a mineral seam which is not dependent upon engagement with the boundary of a seam and other sedimentary layers, e.g., a coal-rock interface.

It is another objective of this invention that means be provided to transmit signals from a rotary cutter to a stationary portion of the machine frame while complying with mine safety requirements and not employing equipment that cannot withstand the rigors of a mining environment.

It is still another objective of this invention that any equipment employed with the replaceable cutters of a commercial rotary coal mining machine be simple and not interfere with the process of replacing cutters so that ordinary mine personnel may replace worn cutters with ordinary, standard new cutters without interfering with the signal detectors.

SUMMARY OF THE INVENTION

The invention is embodied in a mining machine which has means for sensing property variations of the materials associated with a seam of a mine as well as for sensing boundaries or the interface between different materials.

Since coal is a sedimentary material, not only is the seam per se a layer but the coal within the seam is also layered usually generally parallel to the boundaries of the seam. While the properties of the coal within a given seam vary, even if it is uniform, it is not found in a continuous, homogenous mass. Rather there are interfaces, called bedding planes, having little or no tensile or sheer strength lying throughout the seam or vein. Detecting such interfaces on a continuous basis by reading or measuring the vibration pattern of the cutter as it cuts through the coal while knowing the angular position of the cutter, alone can provide valuable information as machine guidelines to enable an operator, located remotely from the rotating cutter, to guide the cutter's heightwise movement from floor to ceiling as the machine traverses the longwall.

Whereas, rotatable cutting members generally include a plurality of cutters often arranged in a helical configuration to cause the cut fragments of coal to be moved parallel to its axis toward a conveyor, the information in the form of vibration variations in but a single cutter is all that is necessary to obtain the information as to property variations of the material associated with the seam.

Some machines employ roller cutters. This invention is applicable to that type of mechanism as well.

Accordingly, the present invention employs at least one cutter carried by a rotatable member at a point spaced from its axis of rotation. A rod is carried by the rotatable member and is held in releasable engagement with the cutter. The rod remains with and rotates with the rotatable member and it extends to the axis of rotation. It conducts vibrations that it receives from the cutter to the axis of the rotating member in the form of strain waves moving at the speed of sound. At the axis, the strain waves are detected by a transducer which converts the waves into electric signals.

All of this is without the use of accelerometers, slip rings, battery operated radio transmitters or any other piece of equipment which might produce electrical sparking or not be sufficiently rugged to withstand the impact forces and dirt associated with the rotary cutting of a mineral such as coal.

In one embodiment of the invention, the conductive rod extends to the axis of the rotary member and there changes direction and extends along the axis to pass through a transducer coil. At least that portion of the rod within the coil is of magnetostrictive material. Hence the strain waves moving in the rod act as moving magnetic variations which induce a voltage in the coil, which in turn, through appropriate instrumentation provides information to the remotely located machine operator.

In accordance with another embodiment of the invention, the vibration conducting rod extends to the axis of rotation and projects into a rotary water gland located at the axis. The waves in the rod are transmitted as vibrations through the water to a non-rotary microphone located within the gland. The microphone, itself a transducer, converts the strain waves in the rod to electric signals.

To isolate the rod from unwanted vibrations, elastomeric mounting means are provided along its path from the cutter to the transducer.

Since reflections of sound waves, i.e. "ringing", can take place in the conductive rod, that embodiment which employs the transducer coil utilizes a damping member directly on the rod adjacent the free end of the rod which extends out of the coil.

The rod, in each instance, is preloaded against the cutter to maintain contact with the cutter.

Since it is desired to utilize conventional mechanisms and conventional cutters, in order to provide means to prevent material from being trapped between the cutter and its mounting block and thus attenuate the signal generated by the cutter motion and received by the rod, clearance means are provided between the cutter and its mounting block.

The above and other features of the invention including various novel details of construction and combinations of arts will now be more particularly described with reference to the accompanying drawings and pointed out in the claims. It will be understood that the particular mining machine vibration sensor embodying the invention is shown by way of illustration only and not as a limitation of the invention. The principles and features of this invention may be employed in varied and numerous embodiments without departing from the scope of the invention.

BRIEF DESCRIPTION OF THE DRAWINGS

FIG. 5 is a schematic elevation illustrating an alternative embodiment of the invention.

FIG. 5A is a view taken on the line V—V on FIG. 5.

FIG. 5B is an alternative construction of the view taken on the line V—V on FIG. 5.

BEST MODE OF CARRYING OUT THE INVENTION

Figure 1:
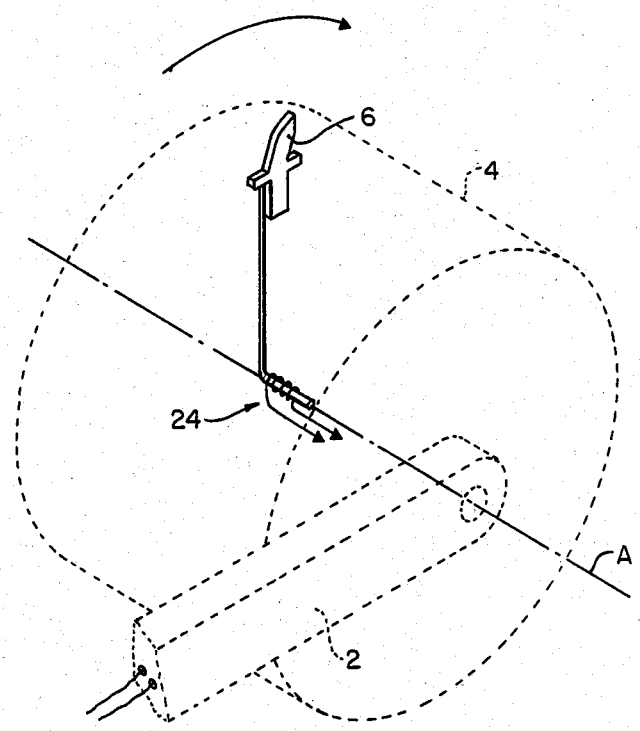
FIG. 1 is a schematic perspective view of a rotatable coal cutting member mounted on a ranging arm and carrying a cutter, a vibration transmitting rod, and a transducer.

The invention is embodied in a longwall mining machine, the cutting portion of which is shown in perspective in FIG. 1. It includes a ranging arm 2 which supports a rotating tool 4 illustrated as a drum or cutter head rotatable about an axis A. The drum or rotary member normally carries a plurality of coal cutters as will be seen in the above-identified Godfrey patent. However, only one cutter 6 is illustrated in FIG. 1.

Whereas, the ranging arm 2 is movable upwardly and downwardly to raise or lower the axis A and, hence, the rotatable member 4, for purposes of describing this invention, the ranging arm may be considered to be stationary relative to the member 4 which is, of course, rotatable.

Figure 2:
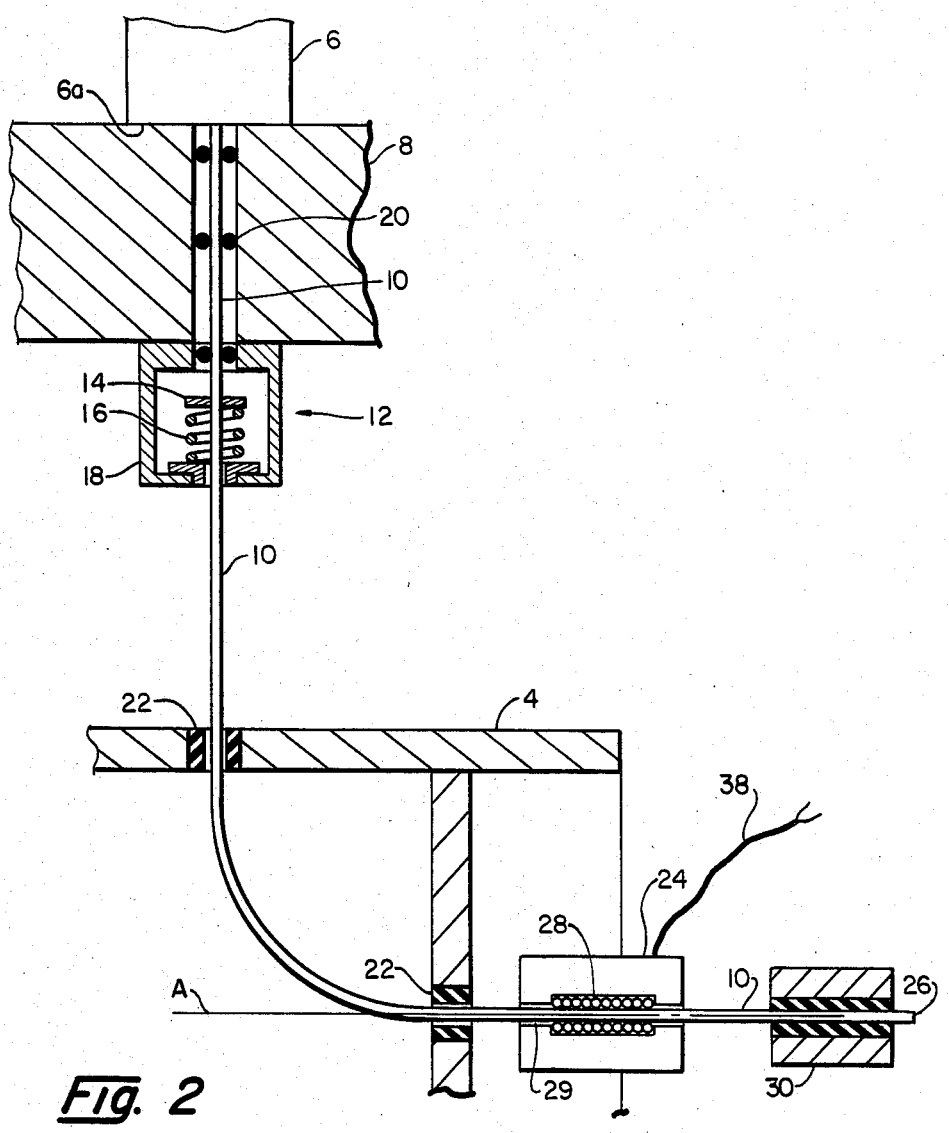
FIG. 2 is a schematic side elevational showing of the operative elements shown in FIG. 1.

Referring to FIG. 2, the cutter 6 is removably held in a block 8 and periodically the cutter is removed for replacement or repair. One end of a vibration conductor rod 10 is held in releasable engagement with the cutter by a biasing means 12 which may, for example, by a commercially available Swage-Lock which clamps on the rod compressing a spring 16 against a housing 18. The conductor rod 10 is urged against the back tab 6a of the cutter 6 with about 10 lbs. of pressure so that it will generally remain in contact with the cutter. The amount of load is adjusted by moving the Swage-Lock fitting upwardly and downwardly on the rod.

A plurality of neoprene O-rings 20 positioned in the cutter block 8 and the housing 18 isolate the rod 10 from extraneous vibrations. Similarly, the rod is isolated by grommets 22 positioned along its path through the housing 18 and the cutter 4.

A transducer coil 24 is located on the axis of rotation A of the rotatable member. The conductor rod extends from the cutter in generally a radial direction toward the axis of rotation A. There it changes direction and extends along the axis and through the transducer coil. Thus, as the member 4 rotates the entire conductor rod 10 rotates, the free end of the rod 26 rotating on the axis A.

As the cutter progresses through a material, such as coal, it generates many fractures which extend beneath and ahead of the advancing cutter. Fracturing results in chips being released. Associated with this fracturing, the cutter experiences numerous forces resulting in vibrations of the cutter.

There are also bedding planes in the coal which are interfaces between adjacent coal strata. Since these planes have essentially no tensile or sheer strength, the vibration pattern of the steady advancing action of the cutter will be interrupted. In like manner when the cutter engages an impurity in the seam, which is either harder or softer than the material being cut, again an interruption or change will result in the cutter vibration pattern. These changes in the vibration patterns are detected by the apparatus of this invention and changed to electric signals which are converted to either visual display or other electric readable means to give an operator guidance in controlling the advancing cutter. Sufficient information can be gathered by monitoring the characteristics within the seam itself rather than just its boundaries.

Magnetostrictive materials experience magnetic changes as a function of stress. Vibrations in the cutter transmitted to the conductor rod create strain waves in the rod which travel therealong at the speed of sound. The waves act essentially as traveling magnets. Upon passing through the coil, the stress waves induce electrical voltage in the coil resulting in a usable electric signal. The signals produced by the coil in conjunction with a signal, produced by any convenient means, indicating the angular position of the cutter can be recorded and/or used to produce a visual display guidance system for a remotely located operator or even used to guide the machine without an operator.

The conductor rod 10 which may also be called an acoustic wave guide is constructed of a magnetostrictive material. One such material could be an alloy sold under the tradename Remendor consisting of 48% iron, 48% cobalt, 3.6% vanadium, and 0.4% magnesium. It should be emphasized, however, that only that portion of the rod which passes through the transducer coil 24 need be of magnetostrictive material.

The transducer 24 may be constructed of a Plexiglas housing with a coil 28 inside and an axial hole 29 to permit the passage therethrough of the conductor rod 10. The transducer coil 24 as herein disclosed, is mounted on the axis A of the rotary member and rotates with the cutter.

The stress wave which is propogated at the interface of the cutter 6 and the conductor rod 10 is a one-dimensional longitudinal wave of energy. At the free end 26 of the conductor rod 10, the energy is reflected and causes the stress wave to travel up and down the rod at its natural frequency. This is called ringing. It will continue to do so at a slowly decaying amplitude. This can cause misleading voltages to be created in the transducer coil. Accordingly, it is desirable to damp out the ringing by placing a damper 30, in the form of a cylindrical rubber core in engagement with the rod 10 adjacent its free end 26. It will be noted that this damper is positioned on the rod after it projects through the coil or downstream of the cutter. Heavy damping at mounting points upstream of the coil would detract from the signal strength.

Figure 3:
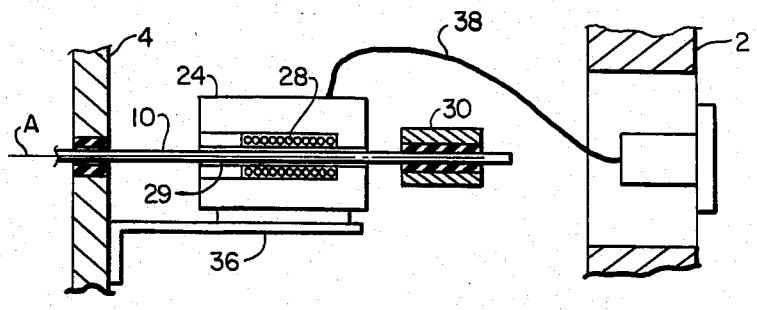
FIGS. 3 and 4 show means, respectively, for mounting the transducer for rotation with the rotary member, and in a stationary position on the machine frame.

The transducer coil 24 may rotate with the member 4 by being mounted on a bracket 36 secured to the rotating hub portion of the member 4 as seen in FIG. 3. The leads 38 from the coil would extend to the "stationary" frame, which in this instance would be the ranging arm 2 and there the signals collected by any appropriate means.

Figure 4:
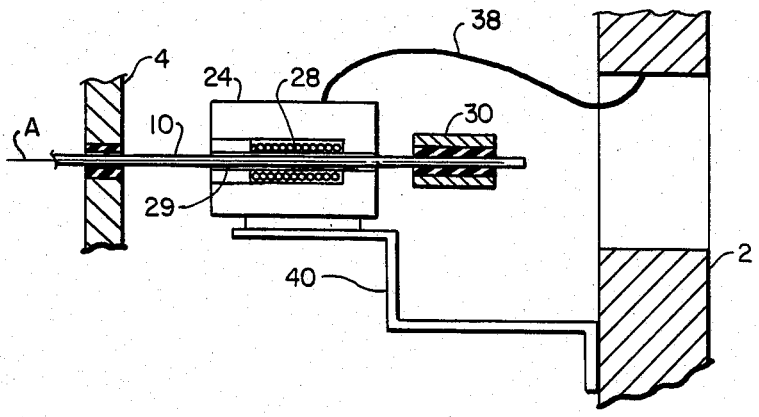

The apparatus is just as effective by making the transducer coil 24 stationary as shown in FIG. 4 whereby it is mounted to the "stationary" ranging arm 2 by a bracket 40. The leads 30 would not rotate but pass directly to the frame, and thence to the signal processor and/or display (not shown).

As long as the coil is located on the axis A, it may either rotate on the axis or be stationary. However, if it is located off the axis, it must rotate about the axis A at the same RPM that the cutter 6 and rod 10 rotate about the axis.

Referring to FIG. 5, an alternative embodiment of the transducer will be seen. It may be considered an "acoustic slip ring". The vibration signals are transmitted toward the axis A of the rotatable member from the member 6 through the rod 10 which projects into a rotating water gland 50 surrounding the axis A of the rotating member. As seen in FIG. 5A, the free end of the rod 10 is beveled at 52 and is aligned with a microphone 54 stationarily mounted within the gland.

As seen in 5B, the rod 10 may be bent at a right angle at 53 and "aimed" at the microphone without beveling.

The microphone, for example, may be a piezoelectricity crystal transducer. Vibration emanating from the end of the rod 10 is transmitted through the water to the microphone and there converted to electric signals, there being no mechanical or electrical contact between the conductor rod and the transducer. In this embodiment of the invention the rod 10 need not be made of magnetostrictive material.

Figure 6:
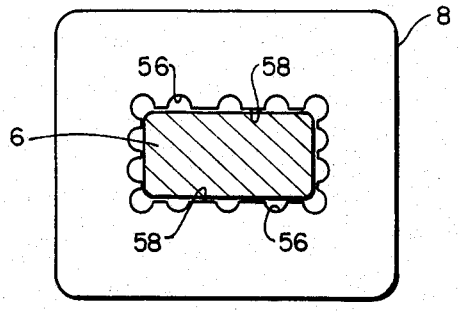
FIGS. 6 and 7 are a top plan view and side elevation, respectively, of means for relieving or preventing debris accumulation between the cutter and the block that carries it.
Figure 7:
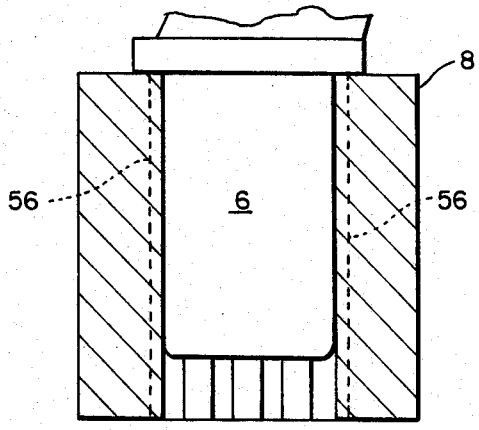

In order to prevent material, such as dust and dirt, from being trapped between the cutter member 6 and its mounting block 8 and attenuate the signal, relief means associated with the cutter 6 and its mounting block 8 are provided. As will be seen in FIGS. 6 and 7, a plurality of vertical channels 56 are formed in the cutter engaging surface of the block 8. The natural vibration will cause accumulated dirt or dust to escape. It should be noted that the channels 56 are spaced from each other leaving walls 58 between channels which are engageable with the cutter, thus, not interfering with the mounting relationship between the cutter 6 and block 8. If desired, the space between the cutter 6 and block 8 can be flushed with air or water.

I claim:

1. A mining machine having means for sensing property variations of the materials associated with a seam of a mine comprising:

a cutting tool including a member rotatable about an axis, at least one cutter carried by the rotatable member at a point spaced from the axis for cutting material from the seam, a conductor rod carried by the rotatable member and held in releasable engagement with the cutter, the rod extending to the axis of the rotatable member to conduct to the axis, strain waves which are induced by variations in cutter vibration as the cutter encounters property variations of the materials associated with the seam, and a transducer located at the axis of the rotatable member in communication with the conductor rod to convert the strain waves in the rod to electric signals.

2. A mining machine in accordance with claim 1 wherein there are elastomeric mounting means in contact with the conductor rod along its path from the cutter to the transducer to isolate the conductor rod from unwanted vibrations.

3. A mining machine in accordance with claim 1 wherein the conductor rod is preloaded against the cutter.

4. A mining machine in accordance with claim 1 wherein clearance means are provided between the cutter and the rotatable member to prevent material from being trapped therebetween and attenuate the signal being received by the cutter.

5. A mining machine having means for sensing property variations of the materials associated with a seam of a mine comprising:

a cutting tool including a member rotatable about an axis, at least one cutter carried by the rotatable member at a point spaced from the axis for cutting material from the seam, a conductor rod carried by the rotatable member and held in releasable engagement with the cutter, the rod extending to the axis of the rotatable member and there changing direction and extending along the axis to conduct to the axis strain waves which are induced by variations in cutter vibrations as the cutter encounters property variations of the materials associated with the seam, a transducer coil at the axis and extending around the rod, at least the portion of the conductor rod which extends within the coil being magnetostrictive to convert the strain waves in the rod into electric signals in the coil.

6. A mining machine in accordance with claim 5 wherein there are elastomeric mounting means in contact with the conductor rod along its path from the cutter to the transducer to isolate the conductor rod from unwanted vibrations.

7. A mining machine in accordance with claim 5 wherein a free end of the conductor rod extends out of the coil and a damping member engages the conductor rod adjacent the free end to reduce ringing of the rod.

8. A mining machine in accordance with claim 5 wherein the conductor rod is preloaded against the cutter.

9. A mining machine in accordance with claim 5 wherein both the transducer coil and the conductor rod rotate with the rotating member.

10. A mining machine in accordance with claim 5 wherein the transducer coil is stationary and the conductor rod rotates with the rotating member.

11. A mining machine in accordance with claim 5 wherein clearance means are provided between the cutter and the rotatable member to prevent material from being trapped therebetween and attenuate the signal being received by the cutter.

12. A mining machine having means for sensing property variations of the materials associated with a seam of a mine comprising:

a cutting tool including a member rotatable about an axis, at least one cutter carried by the rotatable member at a point spaced from the axis for cutting material from the seam, a conductor rod carried by the rotatable member and held in releasable engagement with the cutter, the rod extending to the axis of the rotatable member to conduct to the axis, strain waves which are induced by variations in cutter vibration as the cutter encounters property variations of the materials associated with the seam, a water gland at the axis into which the conductor rod projects, and a microphone within the gland to convert the strain waves in the rod to electric signals as vibrations from the rod are transmitted through the water.

13. A mining machine in accordance with claim 12 wherein there are elastomeric mounting means in contact with the conductor rod along its path from the cutter to the transducer to isolate the conductor rod from unwanted vibrations.

14. A mining machine in accordance with claim 12 wherein the conductor rod is preloaded against the cutter.

15. A mining machine in accordance with claim 12 wherein clearance means are provided between the cutter and the rotatable member to prevent material from being trapped therebetween and attenuate the signal being received by the cutter.

* * * * *